US008434861B2

(12) United States Patent
Pohlt et al.

(10) Patent No.: US 8,434,861 B2
(45) Date of Patent: May 7, 2013

(54) SYSTEM FOR THE FIXING OF PRINTED IMAGES ON A PRINTING SUBSTRATE

(75) Inventors: Michael Pohlt, Munich (DE); Thomas Schwarzenbeck, Poing (DE)

(73) Assignee: Océ Printing Systems GmbH, Poing (DE)

( * ) Notice: Subject to any disclaimer, the term of this patent is extended or adjusted under 35 U.S.C. 154(b) by 474 days.

(21) Appl. No.: 12/706,027

(22) Filed: Feb. 16, 2010

(65) Prior Publication Data

US 2010/0208022 A1 Aug. 19, 2010

(30) Foreign Application Priority Data

Feb. 16, 2009 (DE) ..... 10 2009 009 043

(51) Int. Cl.

| | |
|---|---|
| ***B41J 2/01*** | (2006.01) |
| ***B41J 2/015*** | (2006.01) |
| ***G03G 15/20*** | (2006.01) |
| ***G03G 15/10*** | (2006.01) |

(52) U.S. Cl.
USPC ..... 347/102; 347/103; 347/21; 399/310; 399/237

(58) Field of Classification Search ..... 347/103; 430/112
See application file for complete search history.

(56) References Cited

U.S. PATENT DOCUMENTS

| | | | | |
|---|---|---|---|---|
| 4,053,504 | A * | 10/1977 | Rosenkranz et al. | 560/4 |
| 4,368,669 | A * | 1/1983 | Love, III | 101/492 |
| 4,538,899 | A | 9/1985 | Landa et al. | |
| 5,260,753 | A | 11/1993 | Haneda et al. | |
| 5,378,739 | A * | 1/1995 | Koike et al. | 523/161 |
| 5,801,741 | A * | 9/1998 | Ikegawa | 347/141 |
| 6,059,407 | A * | 5/2000 | Komatsu et al. | 347/103 |
| 6,193,366 | B1 * | 2/2001 | Thomas et al. | 347/103 |
| 6,207,336 | B1 * | 3/2001 | Itaya et al. | 430/118.2 |
| 6,386,696 | B1 * | 5/2002 | Rodi et al. | 347/103 |
| 6,585,364 | B2 * | 7/2003 | Kasperchik et al. | 347/98 |
| 7,174,119 | B2 * | 2/2007 | Sakemi | 399/240 |
| 7,254,363 | B2 * | 8/2007 | Nakamura et al. | 399/336 |
| 7,305,208 | B2 * | 12/2007 | Inoue et al. | 399/328 |
| 7,463,851 | B2 | 12/2008 | Berg et al. | |
| 7,471,907 | B2 | 12/2008 | Berg et al. | |
| 7,603,069 | B2 * | 10/2009 | Yamana et al. | 399/328 |
| 2002/0048713 | A1 * | 4/2002 | Komoto et al. | 430/124 |
| 2006/0001722 | A1 * | 1/2006 | Stelter et al. | 347/103 |
| 2006/0056891 | A1 * | 3/2006 | Hashiguchi et al. | 399/329 |
| 2006/0290761 | A1 * | 12/2006 | Cellura et al. | 347/103 |
| 2007/0196120 | A1 * | 8/2007 | Maeda | 399/69 |
| 2008/0001983 | A1 * | 1/2008 | Kawakami et al. | 347/14 |
| 2008/0095558 | A1 * | 4/2008 | Schleusener | 399/336 |
| 2008/0279597 | A1 | 11/2008 | Berg et al. | |
| 2009/0079784 | A1 * | 3/2009 | Chiwata et al. | 347/21 |
| 2009/0207226 | A1 * | 8/2009 | Ikeda et al. | 347/103 |

FOREIGN PATENT DOCUMENTS

| | | |
|---|---|---|
| DE | 34 06 290 | 8/1984 |
| DE | 691 19 549 | 5/1992 |
| WO | WO 2005/013013 | 2/2005 |
| WO | WO 2007/057387 | 5/2007 |

* cited by examiner

*Primary Examiner* — Stephen Meier
*Assistant Examiner* — Leonard S Liang
(74) *Attorney, Agent, or Firm* — Schiff Hardin LLP

(57) ABSTRACT

Printed images exhibiting a color medium are applied to the printing substrate by a printing device, the printing substrate having been provided beforehand with a viscous fluid film by an application unit arranged in front of the printing device. The color medium of the printed images migrates to a surface of the viscous fluid film and adheres there. After the drying of the fluid film the printed images are firmly fixed on the printing substrate.

26 Claims, 2 Drawing Sheets

SYSTEM FOR THE FIXING OF PRINTED IMAGES ON A PRINTING SUBSTRATE

BACKGROUND

For the imprinting of a printing substrate e.g. of a single sheet or of a web-like printing substrate of the most variable materials, such as e.g. paper or thin plastic or metal films it is known to produce image-dependent charge images on a charge image carrier, e.g. a photo conductor, the charge images corresponding to the images to be printed, comprised of regions to be inked and regions not to be inked. The regions of the charge images to be inked are developed with a developer station by a color medium, e.g. toner or color particles. Then the developed images are reprinted on the printing substrate and fixed there.

A fluid developer containing at least toner and carrier fluid can in the process be used for inking the charge images. A method for such an electrophoretic fluid development (electrographic development) in digital printing systems is e.g. known from W/2007/57387 (US 2008/279597 A1). In the process a carrier fluid containing silicon oil with toner dispersed within is used as a fluid developer.

In the case of the printing device in accordance with WO2007/57387, a loading station, an element for image-wise exposure (character generator), a developer station for the development of the charge images with toner to toner images, a transfer station for reprinting of the toner images on a printing substrate and an element for cleaning of the photo conductor drum after reprinting are arranged along a charge image carrier. The toner images are fed to the printing substrate by the charge image carrier via the transfer station and are reprinted on the printing substrate. For this purpose a transfer roller or a transfer belt is used, the transfer roller or transfer belt taking the toner images e.g. embedded in carrier fluid in the case of the use of a fluid developer and feeding them to the printing substrate. In the reprinting station the toner images are reprinted on the printing substrate and are then fixed there under pressure and using an electric field.

The fixing of the toner images on the printing substrate takes place in a fixing station which is arranged after the transfer station on the printing substrate. In the process the fixing can take place by heat and pressure. Heat is supplied to the printing substrate, through which the toner of the toner images is melted on, in order to coalesce closely to the printing substrate. Heated fixing rollers or radiant heaters can be employed for the supply of heat, the fixing roller or radiant heaters melting the toner images with heat and pressure or radiant heat.

From U.S. Pat. No. 4,538,899 (ED 3406290) in addition it is known to employ a carrier fluid in the case of the use of fluid developers for the fixing of the toner images, the carrier fluid being able to be oxidized. The toner images are transferred with the carrier fluid to the printing substrate. There the carrier fluid is evaporated, wherein the toner images are fixed on the printing substrate by the evaporated carrier fluid.

SUMMARY

It is an object to specify an arrangement for the fixing of printed images in which case the printed images are inked by a color medium, such as e.g. toner, and the inked printed images can be fixed on the printing substrate without the use of heat.

In a system for fixing printed images inked with a color medium on a printing substrate, a printing device supplies the printed images at a transfer point. In front of the transfer point, an application unit adjacent to the printing substrate applies a fluid film on a side of the printed substrate which receives the printed images after the application of the fluid film. The fluid film has a viscosity such that the color medium of the printed images migrates to a surface of the fluid film and remains adhered there. A drying unit after the transfer point dries the fluid film.

DESCRIPTION OF THE PREFERRED EMBODIMENT

Figure 1:
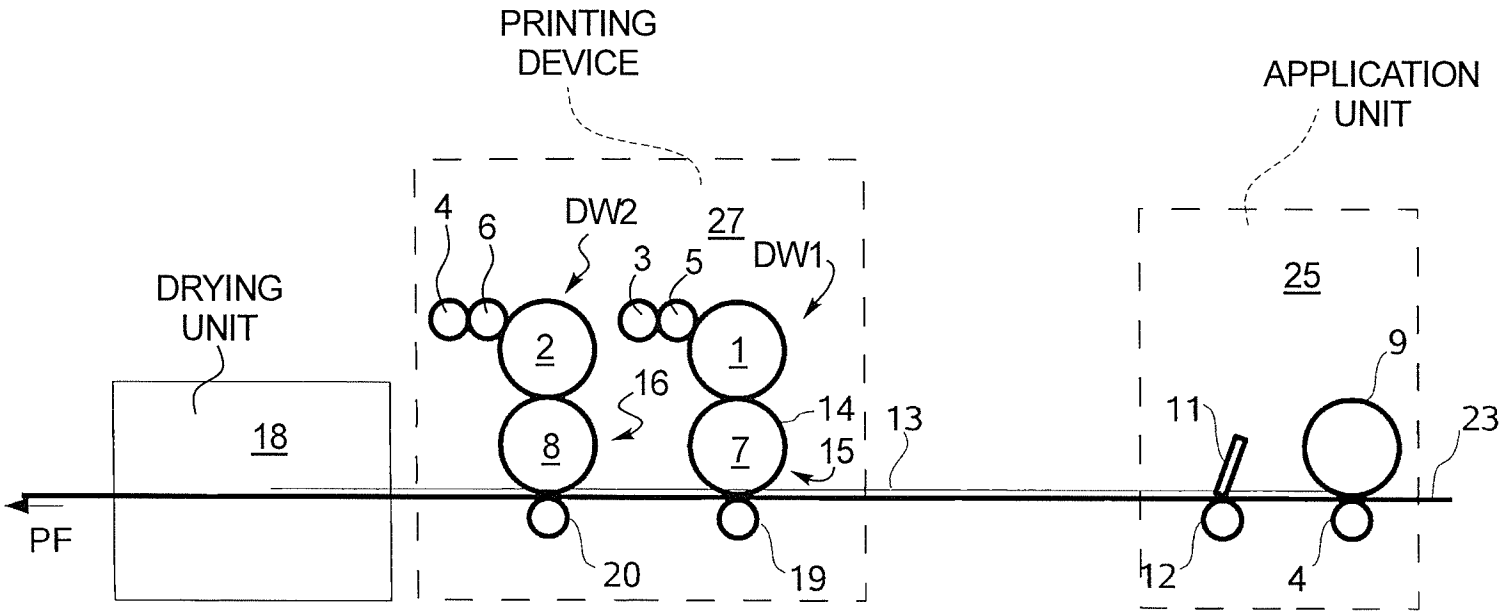
FIG. 1 shows a principle representation of an electrographic printing device with two printing mechanisms.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

The fixing arrangement exhibits an application unit in front of the transfer station which is provided adjacent to the printing substrate and which applies a film from a viscous fluid on the side of the printing substrate to receive the printed images, in which said printing substrate the printed images are subsequently embedded. The color medium migrates to the film of fluid and remains adhered there on the surface. After a drying of the fluid with the printed images the printed images are firmly bonded to the printing substrate.

In the following explanation of the preferred embodiment this viscous fluid is to be named as fixing fluid.

With this the properties of the toner or of the color particle are no longer influential for the fixing of e.g. printed images comprised of toner as the color medium, since the fixing fluid applied to the printing substrate prior to the printing process will be used for fixing. This has the advantage that the transfer efficiency of the toner on the printing substrate can be improved. The toner then no longer has to be optimized to its melting properties, but rather only to its charging properties.

The color particles can be toner particles in an electrographic process, wherein fluid toner or dry toner can be used. The color particles can also be color particles dissolved in a fluid in an offset process. The particle size can be selected preferably in the range from 0.1 to 10 μm. However, in the following toner will be employed as the color medium for the explanation of the preferred embodiment.

The application unit can in simple fashion exhibit two application rollers, between which the printing substrate can be fed through. At least one of the application rollers can apply the fixing fluid to the printing substrate. In order to uniformly distribute the fixing fluid over the printing substrate and apply the fixing fluid in fixed height, a squeegee can be arranged at the output of the application rollers on the side of the printing substrate provided with the fixing fluid. The squeegee can in the process cooperate with a counter bearing on the other side of the printing substrate.

An inkjet printing system can be used as an application unit as another embodiment of the invention. This embodiment has the advantage that the fixing fluid can only be applied in the regions of the printing substrate that are to be printed. For offset printing methods a Flexo printing mechanism can be used as an application unit, which likewise applies the fixing fluid only on regions of the printing substrate which are to be printed.

Emulsion paint or ultra-violet hardening lacquer can be provided as a fixing fluid. Or a material can be used as is employed as a conventional paper coating. Additionally the fixing fluid that is used can contain particles which influence the surface roughness in order to design the surface impression of the printed area. In addition the fixing fluid can contain dyes in order to influence the color of the printing substrate.

In order to prevent an oxidation of the fixing fluid into the printing substrate or to prevent a retransfer of fixing fluid into a following printing mechanism of a printing device with several printing mechanisms, it is expedient to select the viscosity of the fixing fluid >1000 mPa*s.

In advantageous manner the preferred embodiment can in the case of an electrographic printing or copying device be employed for the fixing of the toner images reprinted on the printing substrate. In the case of such a printing device charge images of the images to be printed are produced on a charge image carrier, the images being developed in a developer station to toner images, wherein the toner images are reprinted in a transfer station on the printing substrate. If the transfer station exhibits a transfer roller pair, between the pair which the printing substrate with the fixing fluid is fed through, with the help of an electric voltage existing between the transfer rollers the charged toner in the fixing fluid can be drawn on the printing substrate. If the toner images are embedded in a carrier fluid, the toner in the transfer station migrates from the carrier fluid into the surface of the fixing fluid. This operation is supported if the viscosity of the carrier fluid is selected lower in comparison to the viscosity of the fixing fluid.

It is advantageous if the properties of the carrier fluid and the fixing fluid are selected in such a way that they can form a chemical compound. Then the mixture of toner and carrier fluid is bound even better to the printing substrate. The properties are in addition set in such a way that the lowest possible cohesion to the surface of a transfer roller of the transfer station exists and the coating remains as completely as possible on the printing substrate and does not partially pass over onto the transfer roller.

Additionally the possibility exists of applying a product on the printing substrate after the printing mechanisms of the printing device which forms a chemical compound with the printing substrate and which seals the printed image.

A series of advantages arise from the use of the preferred embodiment in the case of a printing device:

- If paper is used as a printing substrate, lighter paper can be used since prior to the reprinting in a first step a coating is applied. As a result paper can be economized.
- A simpler toner can be used, since one does not have to take into consideration the melting properties of the toner.
- A drying of the fixing fluid after the transfer station can be carried out with less energy, since the toner does not have to be melted. With this the web travel properties are improved and the shrinkage of the printing substrate is reduced.
- A finishing effect can be achieved through the applied fixing fluid. An enameling or a matte or glossy surface coating can be produced on the printing substrate.

The preferred embodiment will be explained more closely with the help of an exemplary embodiment which is shown in the figures. The figures show the following:

In FIG. 1 an electrographic printing device 27 is shown with two printing mechanisms DW1, DW2. From each printing mechanism DW1, DW2 a rotating photoconductor drum 1, 2 is shown as a charge image carrier, to which is to be fed a film e.g. from fluid developers. The fluid developer is fed by a raster roller 3, 4 of a developer roller 5, 6, which for the development of charge images on the photoconductor drum 1, 2 goes past the fluid developer on the photoconductor drum 1, 2. In dependency on the charge images on the photoconductor drum 1, 2 toner migrates from the fluid developer rollers 5, 6 onto the photoconductor drum 1, 2 and inks the charge images to toner images. Hence a fluid film comprised of carrier fluid and toner from the raster roller 3, 4 over the developer roller 5, 6 to the photoconductor drum 1, 2. The toner images migrate from the photoconductor drum 1, 2 to a transfer station 15, 16, the transfer station in principle being represented by a transfer roller 7, 8 and a counter-pressure roller 19, 20. A printing substrate 23 is transported in the direction of the arrow PR through the transfer station 15, 16 and in the process is pressed by the counter-pressure roller 19, 20 on the transfer roller 7, 8. From the photoconductor drum 1, 2 to the printing substrate 23 a film is comprised of carrier fluid, in which the toner images are embedded. The transition of the toner images from the transfer roller 7, 8 to the printing substrate 23 can be supported by an electrical voltage applied between the transfer rollers 7, 8 and the counter-pressure rollers 19, 20.

After the reprinting of the toner images on the printing substrate 23 the toner images have to be fixed on the printing substrate 23. For this purpose, in accordance with the preferred embodiment an application unit 25 is used which is arranged in front of the printing device 27 viewed in the transportation direction of the printing substrate 23. The application unit 25 exhibits an application roller 9 with counter-pressure roller 4 with which, in the case of the exemplary embodiment a film from a viscous fluid, the fixing fluid 13, is applied to the printing substrate 23 only with the application roller 9. In order to distribute the fixing fluid 13 applied on the printing substrate 23 uniformly on the printing substrate 23 a squeegee 11 with a counter bearing 12 is provided after the application roller 9. With the squeegee 11 the coating density in fixing fluid 13 is determined and in addition the fixing fluid 13 is uniformly distributed. Hence a uniform film of fixing fluid 13 is arranged on the printing substrate 23 after the application unit 25, the film being able to be supplied to the printing device 27.

Figure 2:
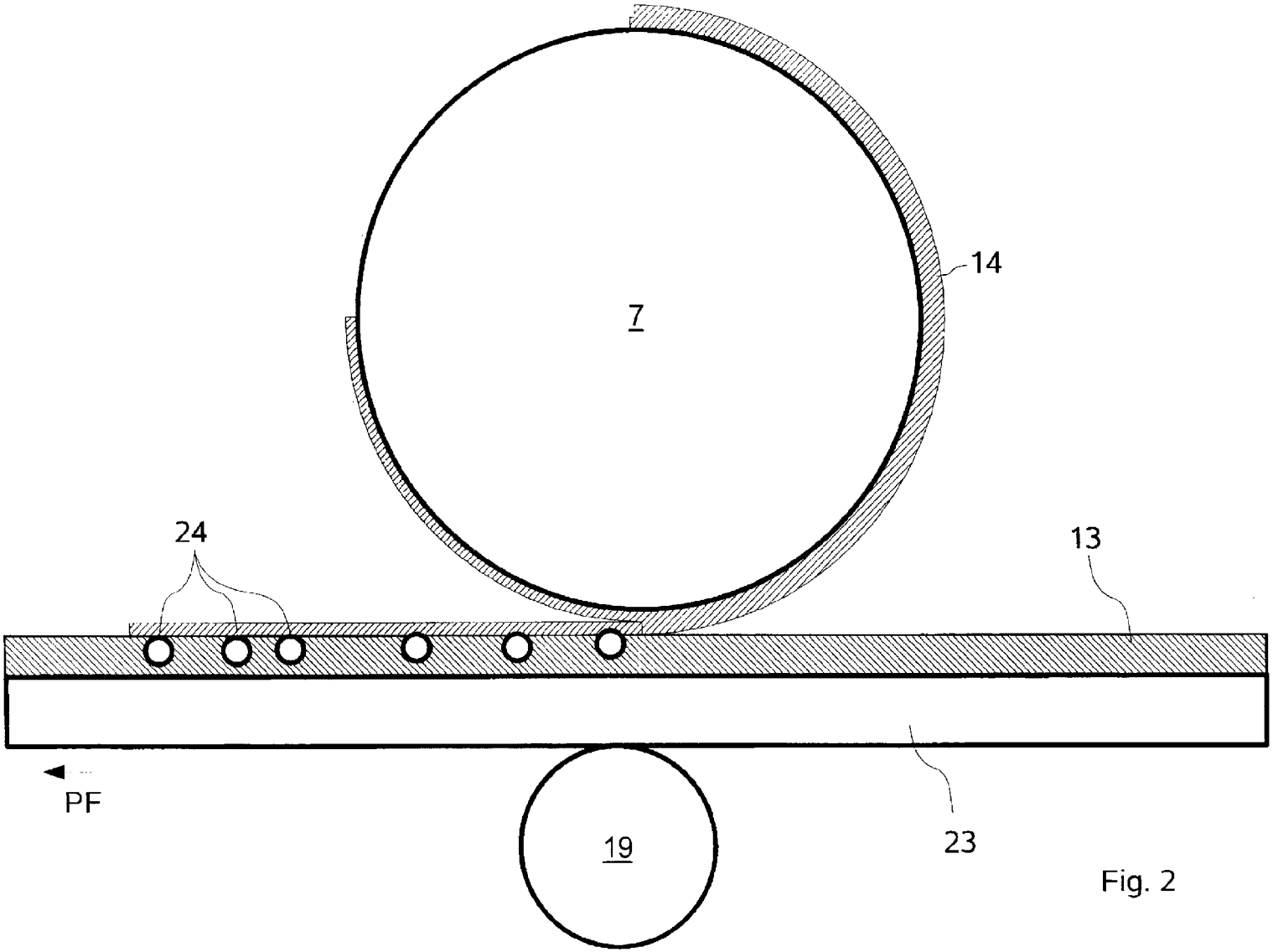
FIG. 2 shows a transfer station of an electrographic printing device with representation of the transition of the printed images from a transfer roller to the printing substrate.

In the printing device 27 toner images are reprinted on the printing substrate 23 in the printing mechanisms DW1, DW2. FIG. 2 shows this step in principle. A coating 14 of carrier fluid with the embedded toner images is transported to the printing substrate 23 by the transfer roller 7. The fixing fluid 13 is arranged on the printing substrate 23. At the transfer point the coating 14 splits, under the influence of an electric field existing between the transfer roller 7, and counter-pressure roller 19, the toner images migrate in a partial coating in carrier fluid 14 to the fixing fluid 13, a remnant/residue in carrier fluid remaining on the transfer roller 7 and can be cleaned off from there. At the transfer point toner particles 24 migrate from the coating to the fixing fluid 13. If the viscosity of the fixing fluid 13 is great in comparison to that of the carrier fluid in the coating 14 the toner migrates electrophoretically through the layer 14 and into the fixing fluid 13 and remains adhered there in the upper region. In the process a retro-reaction of the fixing fluid 13 on the transfer roller 7 is prevented.

After the toner images have migrated to the fixing fluid 13, the fixing fluid 13 can be dried by a drying unit 18 arranged behind the transfer station 15, 16. This can take place by the supply of heat or in the case that an ultra-violet hardening lacquer is used as a fixing fluid 13, by means of ultraviolet radiation. In the process the toner is not melted, since the toner is embedded in the fixing fluid 13 and is firmly bonded with said fixing fluid. The fixing fluid 13 can in addition be influenced in such a way that the fixing fluid 13 with the printed images after the drying in the drying unit 18 exhibits additional creative properties. For example dyes can be admixed to the fixing fluid 13 and with this the color of the printing substrate 23 can be altered. Or particles can be admixed to the fixing fluid 13 in order to set the roughness of the surface of the printing substrate 23 or to produce a matte or glossy surface impression.

The preferred embodiment has been described using the example of an inking with fluid developers in the case of an electrographic printing device. The preferred embodiment is however not restricted to this; it can also be used with dry toner or with color particles dissolved in fluid. Additionally instead of the photoconductor drums 1, 2 and transfer rollers 7, 8 belts can also be used.

Instead of the application roller 9 jets can also be employed for the application of the fixing fluid 13. In the case of an additional embodiment of the invention an inkjet printing system can be used as an application unit 25. This embodiment has the advantage that the fixing fluid 13 can be applied only in the regions of the printing substrate 23 which are to be printed. For offset printing methods a Flexo printing mechanism can be used as an application unit 25, the Flexo printing mechanism likewise applying the fixing fluid 13 only on regions of the printing substrate 23 that are to be printed.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A system for fixing of printed images, comprising:

a transfer element having a carrier fluid with a color medium therein forming said images to be printed, said transfer element being arranged adjacent to a printing substrate at a transfer point;

an electric field at said transfer point;

an application unit in front of the transfer point viewed in a direction of transport of the printing substrate, said application unit applying a fixing fluid on a side of the printing substrate which receives the printed images after the application of the fixing fluid;

said electric field at said transfer point being designed such that the color medium migrates from the carrier fluid into an upper region of the fixing fluid;

at an upper region of said fixing fluid said color medium transferred from said transfer element being embedded in said upper region of said fixing fluid to form said printed images;

said fixing fluid having a viscosity such that the color medium stays embedded and remains adhered thereto; and a drying unit after the transfer point which dries the fixing fluid including the embedded color medium such that the color medium does not melt.

2. The system of claim 1 wherein the color medium is adjacent a surface of the fixing fluid.

3. The system of claim 1 wherein said viscosity of the fixing fluid is great in comparison to a viscosity of the carrier fluid.

4. The system of claim 1 in which the application unit has an application roller and a counter pressure roller between which the printing substrate is fed through, the application roller applying the fixing fluid to the printing substrate.

5. The system of claim 4 in which at an output of the application roller on the side of the printing substrate provided with the fluid film a squeegee is arranged which distributes the fluid film uniformly over the printing substrate.

6. The system according to claim 1 in which the application unit comprises an inkjet printing system which applies the fixing fluid only in regions of the printing substrate in which printed images are applied.

7. The system of claim 1 in which as said printing device said carrier fluid with said color medium representing said printed images is provided via a transfer roller as said transfer element which receives said printed images inked with said color medium in said carrier fluid from a photo-conductive drum, a portion of said carrier fluid remaining on said transfer roller after said transfer point and another portion of said carrier fluid being on said fixing fluid.

8. The system according to claim 1 in which the fixing fluid is comprised of an emulsion paint.

9. The system according to claim 1 in which the fixing fluid is comprised of ultra-violet hardening lacquer.

10. The system according to claim 1 in which the viscosity of the fixing fluid is >1000 mPa*s.

11. The system according to claim 1 in which the fixing fluid has particles influencing a printed surface at the printing substrate.

12. The system according to claim 1 in which the color medium exhibits color particles whose size ranges from 0.1 μm to 10 μm.

13. The system of claim 1 wherein the system is an electrographic printing or copying device.

14. A method for fixing of printed images formed with a color medium transported via a carrier fluid to a printing substrate, comprising the steps of:

providing a transfer element which applies the images to be printed at a transfer point on the printing substrate;

in front of the transfer point viewed in a direction of transport of the printing substrate providing an application unit adjacent to the printing substrate which applies a fixing fluid on a side of the printing substrate which receives the printed images after the application of the fixing fluid;

at said transfer point providing an electric field;

at said transfer point, migrating said color medium from the carrier fluid into an upper region of the fixing fluid by influence of said electric field, said fixing fluid being provided with a viscosity such that the color medium stays embedded in said upper region of the fixing fluid and remains adhered thereto; and providing a drying unit after the transfer point and drying with the drying unit the fixing fluid including the embedded color medium such that the color medium does not melt.

15. The method of claim 14 wherein the color medium is adjacent a surface of the fixing fluid.

16. The method of claim 15 wherein said viscosity of the fixing fluid is great in comparison to a viscosity of the carrier fluid.

17. The method of claim 16 in which the application unit has an application roller and a counter pressure roller between which the printing substrate is fed through, the application roller applying the fixing fluid to the printing substrate.

18. The method of claim 17 in which at an output of the application roller on the side of the printing substrate provided with the fluid film a squeegee is arranged which distributes the fluid film uniformly over the printing substrate.

19. The method according to claim 14 in which the application unit comprises an inkjet printing system which applies the fixing fluid only in regions of the printing substrate in which printed images are applied.

20. The method of claim 14 in which as said printing device said carrier fluid with said color medium representing said printed images is provided via a transfer roller as said transfer element which receives said printed images inked with said color medium in said carrier fluid from a photo-conductive drum, a portion of said carrier fluid remaining on said transfer roller after said transfer point and another portion of said carrier fluid being on said fixing fluid.

21. The method according to claim 14 in which the fixing fluid is comprised of an emulsion paint.

22. The method according to claim 14 in which the fixing fluid is comprised of ultra-violet hardening lacquer.

23. The method according to claim 14 in which the viscosity of the fixing fluid is >1000 mPa*s.

24. The method according to claim 14 in which the fixing fluid has particles influencing a printed surface at the printing substrate.

25. The method according to claim 14 in which the color medium exhibits color particles whose size ranges from 0.1 μm to 10 μm.

26. The method of claim 14 wherein the transfer element images were formed according to an electro-photographic process.

* * * * *